United States Patent [19]

Essig

[11] Patent Number: 4,490,994

[45] Date of Patent: Jan. 1, 1985

[54] FLAT KNITTING MACHINE HAVING NEEDLE SELECTOR DEVICE

[75] Inventor: Karl Essig, Gaienhofen, Fed. Rep. of Germany

[73] Assignee: H. Stoll GmbH & Co., Reutlingen, Fed. Rep. of Germany

[21] Appl. No.: 535,254

[22] Filed: Sep. 23, 1983

[30] Foreign Application Priority Data

Oct. 12, 1982 [DE] Fed. Rep. of Germany ..... 3237732

[51] Int. Cl.[3] ..... D04B 7/00; D04B 15/66

[52] U.S. Cl. ..... 66/75.1; 66/75.2; 66/78

[58] Field of Search ..... 66/75.1, 75.2, 78

[56] References Cited

U.S. PATENT DOCUMENTS

| | | | |
|---|---|---|---|
| 3,605,450 | 3/1969 | Goller et al. | 66/78 |
| 3,693,377 | 9/1972 | Hadam | 66/75.2 |
| 4,287,727 | 9/1981 | Otoshi | 66/75.2 |
| 4,294,085 | 10/1981 | Traütner | 66/75.1 |
| 4,409,801 | 10/1983 | Shima | 66/75.1 |

FOREIGN PATENT DOCUMENTS 2842054 5/1979 Fed. Rep. of Germany ..... 66/75.2

*Primary Examiner*—Ronald Feldbaum
*Assistant Examiner*—Mary A. Ellis
*Attorney, Agent, or Firm*—Larson and Taylor

[57] ABSTRACT

In a flat knitting machine having a needle selector device and selector jacks (50), which can be acted on by press cam parts, and needles (42) with a butt (47) which can be disconnected from the cam parts, there are arranged, in the direction of movement of the machine at each side of each needle selection locality (21) of the needle selector device, a cam part (23, 24). Both cam parts (23, 24) serve to move selected selector jacks (50) longitudinally and to effect a longitudinal movement into different positions (O, I, II) of the selector jacks. Furthermore, each knitting system is provided, for both directions of movement, each with a pair of adjustable draw-off cam parts (15, 17) of different draw-off length, the one of which parts acts on a fixed butt (44) of the needles (42) and the other on the butt (47) which can be disconnected by means of the selector jack (50).

9 Claims, 21 Drawing Figures

FLAT KNITTING MACHINE HAVING NEEDLE SELECTOR DEVICE

The invention is concerned with a flat knitting machine comprising needle selector device, at least one needle bed accommodating longitudinally movable needles, and at least one knitting system comprising cam parts, wherein needle bed and knitting systems are movable relative to one another, each needle has associated therewith a selector jack which can be acted on by press cam parts and can be adjusted in the longitudinal direction of the needles between different positions, and each needle has a butt which can be moved out of the region of influence of cam parts which move the needle longitudinally.

Flat knitting machines of the above-mentioned type are known, for example from DE-OS No. 23 15 134. In those flat knitting machines the movable butts are formed on spring sections of the needle shank and, for controlling the needles, in addition to the selector jacks, needle pushers, intermediate pushers or the like are necessary, which generally render necessary inserts in the needle bed suited for their mounting. The knitting systems are provided with draw-off cam parts which can be preset at different draw-off lengths, but do not allow the formation of stitches or hooks of different length in a stitch course. If stitches of different length in a stitch course are desired, auxiliary weaving fingers or other auxiliary tools must be inserted, which must be preset to determined knitting lengths.

By the insertion of auxiliary tools, intermediate members in the needle control and separate mounting points for needle pushers and selector jacks, not only are the manufacturing costs of the flat knitting machine increased, but also additional sources of operating troubles are created. The insertion of needles with sprung shank sections or spring elements for returning the needle pushers or selector jacks generally limits the operating speeds of the flat knitting machine or leads to a relatively long mode of construction of the knitting systems in the direction of movement of the flat knitting machine because a spring-related return time, and thus return distance, must be included in the knitting locality regions if the machine is to work securely in operation.

In the general struggle to extend the pattern possibilities in flat knitting machines and to produce knitted articles which are to be further treated without rejects, it is desirable that, for facilitating larger transposition jumps, knitting should be more loosely knit in certain regions, thus in the region of cable stitch patterns or in the marginal region of form-knitted goods, than in other regions. The invention is based on the object of so constructing a flat knitting machine having needle selector device that, with high operating security, the possibilities of forming knitting articles without modifying or exhanging the parts of the knitting system can be enlarged in comparison with machines known up to now.

The stated object is resolved by a flat knitting machine of the type set out in the introduction, in accordance with the invention, in that in the direction of movement of the machine at each side of each needle selector locality of the needle selector device is arranged a cam part for moving selected selector jacks longitudinally, and both cam parts effect the longitudinal movement into different positions, in that each knitting system has, for the two directions of movement, each a pair of adjustable draw-off cam parts of different draw-off length, the one of which acts on a fixed butt of the needles and the other as a butt thereof which is movable by means of the selector jacks, and in that for each position of the selector jacks separately controllable press cam parts are provided. In such machine, the movable butt of the needle can advantageously be formed on a needle arm which is pivotally connected with the rectilinearly guided needle shank, which has the fixed butt, the free end of said arm opening into a bifurcated opening of the associated selector jack, which is in the form of a see-saw. In this way in the knitting machine constructed in accordance with the invention spring elements for returning the movable needle butt or the selector jacks are avoided and the needle arm carrying the movable needle butt is controlled directly by the selector jack which is in the form of a see-saw, said jack being for its part brought into each of its positions by movable cam parts, not by spring elements. In this way switching positions and distances can be exactly determined, which finally leads to a shortening of the construction time of the knitting systems.

An auxiliary needle bed, as in conventional flat knitting machines with needle selector device, can be dispensed with, because the needles are controlled directly by the selector jacks without intermediate members, and the selector jacks can be accommodated in the same slots of the needles bed as the needles. By the exclusive forced movement of the selector jacks by means of the cam parts any soiling of the needle bed which may arise cannot lead to sticking of the needle parts or of the selector jacks, as can be the case with machine parts moved by springs.

By the arrangement of longitudinal pusher cam parts in the direction of movement of the machine at both sides of each needle selector locality and the different construction of the cam parts in relation to the adjustment distance effected by them, in combination with the draw-off cam parts arranged in pairs a different draw-off length can be achieved so that in one stitch course longer stitches or longer tucks can be formed at freely selected localities than at adjacent localities without weft fingers having to be inserted on the take-off comb or other auxiliary tools. The needles of the knitting machine constructed in accordance with the invention are always guided rectilinearly with their region supporting the needle head and thus ensure a secure thread take-up and formation of stitches and hooks as a basis for a clean knitting formation.

A greater advantage of a flat knitting machine constructed in accordance with the invention consists in that it allows a variable slide stroke. Only selected selector jacks can be moved longitudinally; the selector jacks not selected remain in their initial position.

A further important advantage of the invention consists in that it can be used also on flat knitting machines in which the knitting localities are fixed and the needle beds, together with the needles and selector jacks, are moved past the fixed knitting localities.

Examplary embodiments of the parts, essential to the invention, of a flat knitting machine constructed in accordance with the invention will be hereinafter explained in closer detail with reference to the appended drawing. More particularly:

Figure 1:
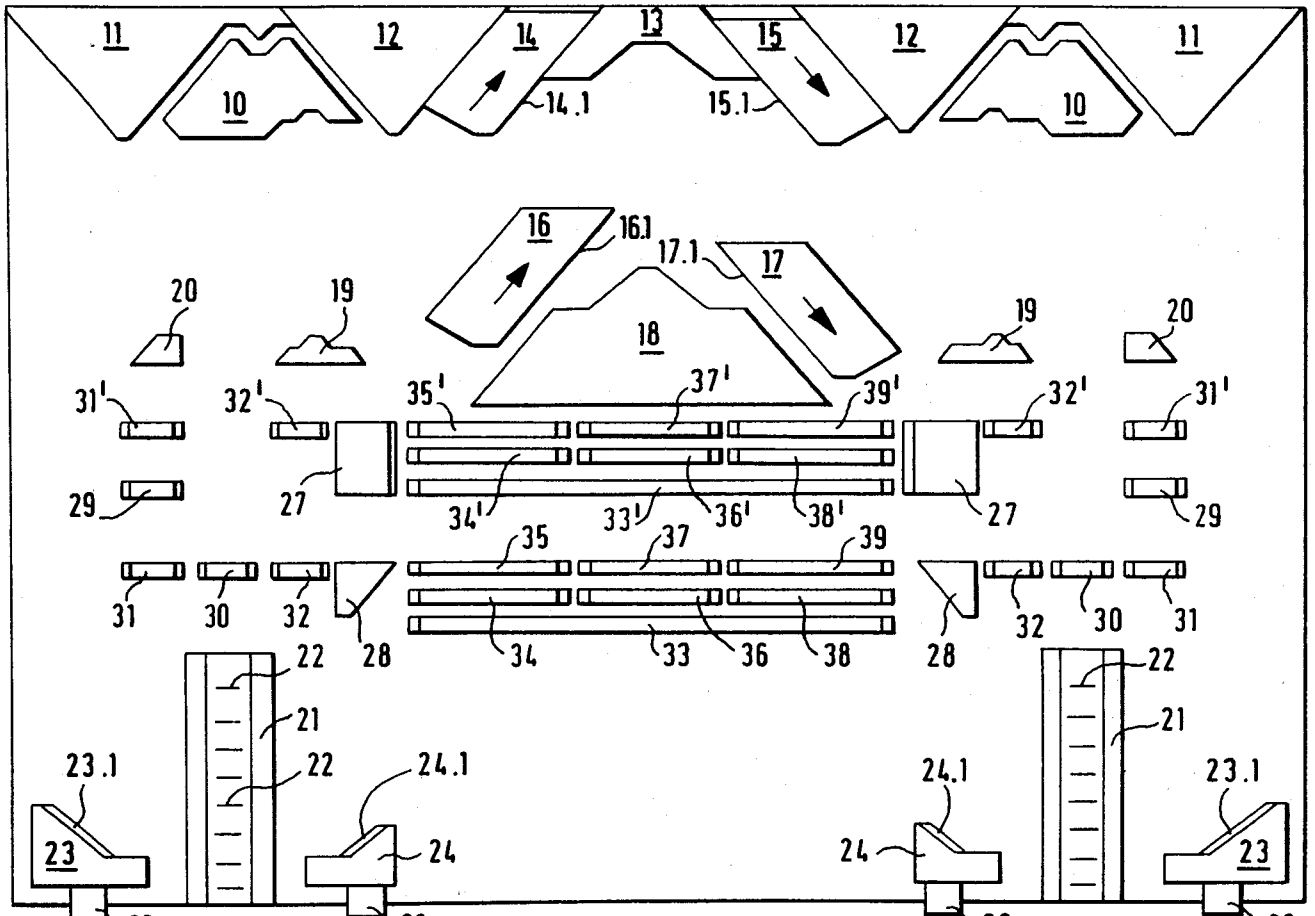
FIG. 1 shows a schematic plan view of the cam parts of a knitting system of the flat knitting machine.

The plan view of FIG. 1 shows the cam parts of a knitting system operative in both directions of movement of a flat knitting machine, said system having a symmetrical construction in known manner. The arrangement has two transfer cam parts 10 on non-adjustable cam parts, with associated guide cam parts 11 and 12 and a guide cam part 13. At both sides of the thread guide cam part 13 are arranged adjustable draw-off cam parts 14 and 15 having operative draw-off edges 14.1 and 15.1. Each of the two draw-off cam parts 14 and 15 has associated therewith a further adjustable draw-off cam part 16 and 17 respectively having operative draw-off edges 16.1 and 17.1, the operative draw-off edge 16.1 being longer than the operative draw-off edge 14.1, and the operative draw-off edge 17.1 being longer than the operative draw-off edge 15.1. The butts of the needles 42 of the knitting machine, to be described more closely hereinafter, are furthermore acted on by a central opening cam part 18 and by closing cam parts 19 and 20 for the transfer cam parts 10. The cam parts 18–20 are also fixedly mounted, that is to say cannot be switched.

Figure 2:
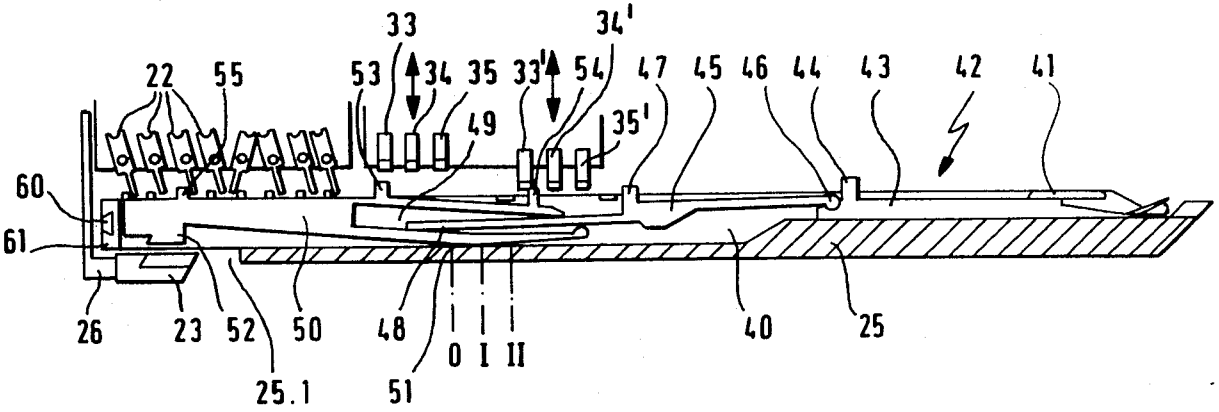
FIG. 2 shows a section through a needle bed of the machine along one needle slot.

In the lower half of the plan view of FIG. 1 are similarly arranged cam parts, controllable by selector jacks described more closely hereinafter, and two selector localities 21. The localities 21 are occupied by electromagnetically pivotable press cam parts 22, which can be seen in detail in FIG. 2, more particularly by eight press cam parts 22 arranged in a row. At both sides of the selectors localities 21 are arranged longitudinal pusher cam parts viz. a longitudinal pusher cam part 23 with a longer operative camming edge 23.1, and a longitudinal pusher cam part 24 with a shorter operative camming edge 24.1. The cam parts 23 and 24 are not arranged in the same place as the other cam parts, but rather on the under-side of the needle bed 25, as shown in FIG. 2. They are connected to the cam box plate of the knitting system by angle holders 26 shown diagrammatically in FIG. 1.

In its middle region the knitting system has press cam parts which are electromagnetically adjustable, in a manner not shown, predominantly vertically to the plane of the drawing. These are constituted by movable presenter cam parts 27 and associated fixed stripper cam parts 28, fixed presenter cam parts 29 and fixed press-down cam parts 30 facing the selector localities 21. At both sides of the fixed press-down cam parts 30 are arranged movable press cam parts 31 and 32, which face closing cam parts 19 and 20 and with each of which is associated a further press cam part 31', 32', respectively. In the central region of the knitting cam box of the knitting system are arranged further press cam parts 33, 34, 35, 36, 37, 38, 39, which each have a corresponding counter-member 33'–39'. These paired movable press cam parts 31, 31', 32, 32' . . . 39, 39' are all so controlled that, for example, if the press cam part 31 is switched in, the counter-member, namely the press cam part 31', is switched out and vice versa.

From the section view of FIG. 2 can be seen the knitting and control tools of the flat knitting machine. In each slot 40 of the needle bed 25 is a knitting needle 42 having a needle shaft 43 which is solidly and non-pivotally guided beneath a needle bed wedge 41 and on which a first, fixed, needle butt 44 is formed. A pivotal needle arm 45 is hingedly connected with its one end 46 to this needle shaft 43. The arm supports a second needle butt 47 which is movable by virtue of the pivotal arrangement of the needle arm 45. The other, free, end of the needle arm 45 projects into a bifurcated opening 49 of a selector jack 50 accommodated in the same needle bed slot 40.

The selector jack 50 is in the form of a see-saw and has a fulcrum 51 on its underside. By moving the selector jack 50 longitudinally, this fulcrum can be set in three different positions, O, I, II, which are indicated in FIG. 2 and in FIGS. 5–12 each by chain-dot lines. At its rearward end the selector jack 50 has on its under-side a butt 52 for longitudinal movement, in the region of which the needle bed 25 is provided with a cut-out 25.1. On its top side the selector jack 50 has two operating butts 53 and 54, which are disposed at different sides of the lower fulcrum 51 and at a certain distances from this pivot locality. Also on its top side each selector jack has, in its rearward half, a selector butt 55 which can be acted on by the pivotal press cam parts 22, the selector butt 55 of adjacent selector jacks 50 being arrangeable in known manner in a stepped relationship; in the present case, they are distributed in eight steps, one of the press cam plates 22 of the selector locality 21 being associated with each step.

The distance between the two operating butts 53 and 54 corresponds to the distance between the press cam parts 31–39, visible in FIG. 1, each from its counter-member 31'–39'. Thus the press cam parts 31–39 operate on the operating butt 53 and the associated press cam parts 31'–39', each oppositely switched, operate on the other operating butt 54 of the selector jacks 50.

For strengthening the needle bed 25 in its marginal region, which is provided with the cut-outs 25.1, spacers 61 supported by a wedge 60 are arranged between the needle bed slots 40. FIG. 2 shows also one of the longitudinal presser cam parts 23, which are arranged in the region of a needle bar cut-outs 25.1 and act on the longitudinal pusher foot 52 of said selector jacks 50, which have been pivoted, out of the rest position shown, anti-clockwise about the fulcrum 51 by a press cam part 22 of the selector locality 21. In the rest position shown in FIG. 2 the longitudinal pusher foot 52 of the selector guide 50 is disposed outside the region of influence of the longitudinal pusher cam parts 23 and 24, and the selector jack 50 holds the associated needle shank 45 in a lower position in which the movable needle butt 47 is pivoted out of the region of influence of the cam parts 16–20. The fixed needle butt 44 co-operates with the upper cam parts 10–15 of the knitting system shown in FIG. 1.

The function of the needle selector locality 21 will be hereinafter explained with reference to the two FIGS. 3 and 4.

Figure 3:
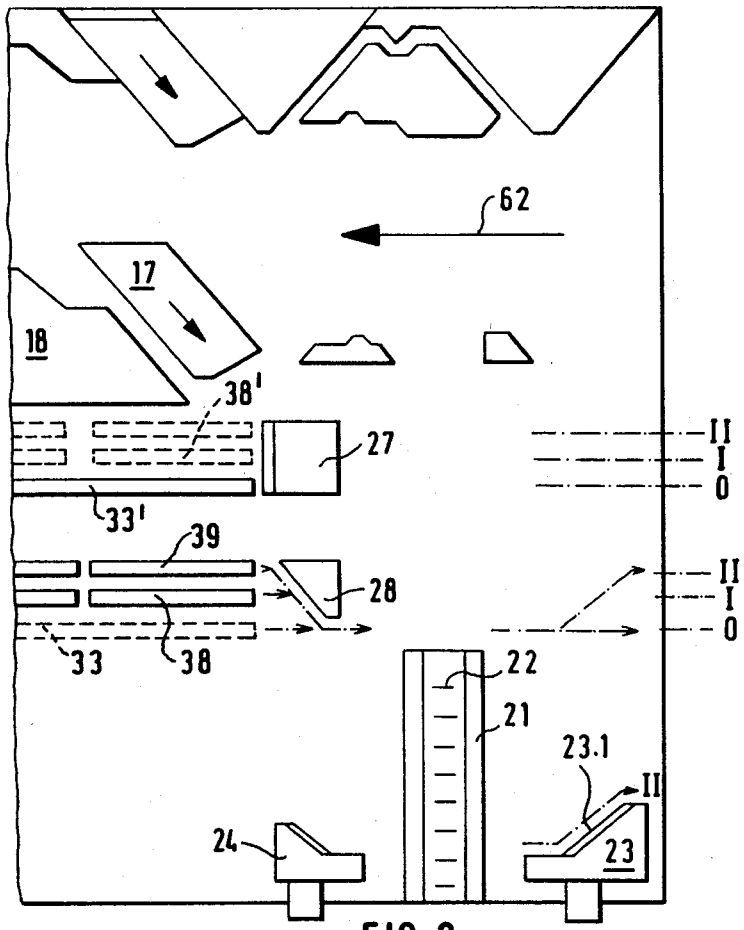

FIG. 3 shows a knitting system moved in the direction of the arrow 62 shown relative to the needle bed 25 (not shown). The wide presenter cam part 27 engages the operating butts 54 of all the selector jacks 50 which have been pre-selected, independently of which of the three positions O, I, II the jacks 50 are disposed in. Thus all the selector jacks 50 are pivoted into rest position, seen in FIG. 2, in front of the selector locality 21; in said position the movable needle butt 47 is brought into an inoperative position. On the other hand, the operating butts 53 of all the selector jacks 50 project from the needle bed and are engaged by the stipper cam part 28 which sets all the selector jacks from positions I or II in an initial position O. All the selector jacks are thus presented to the selector locality 21 and can be acted on there by a press cam part 22.

Figure 5:
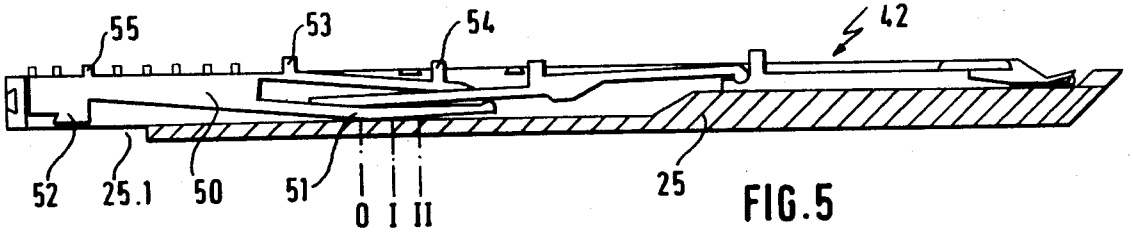
FIGS. 5 to 12 show longitudinal sections through the needle bed corresponding to FIG. 2, with selector jacks and needles in different positions.
Figure 6:
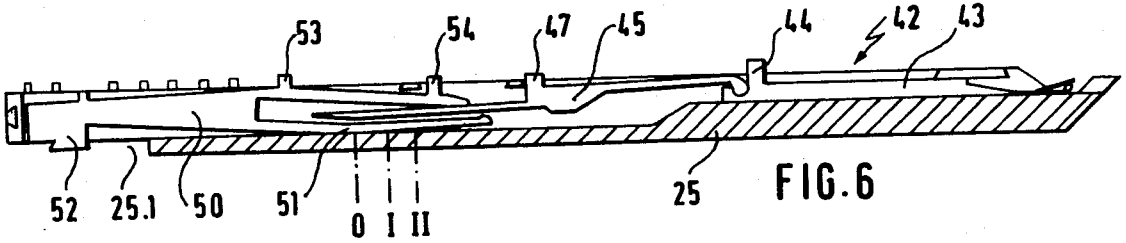
Figure 10:
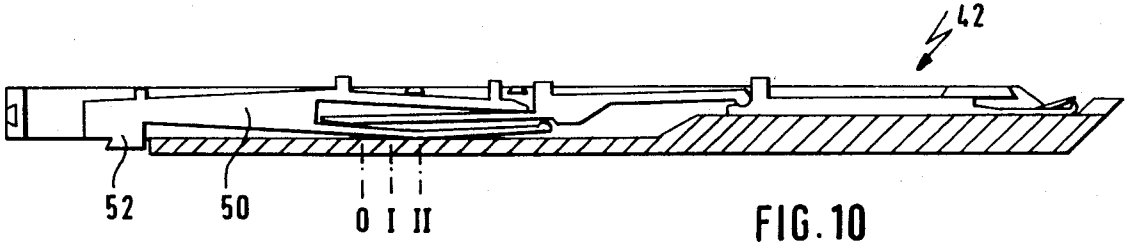
Figure 11:
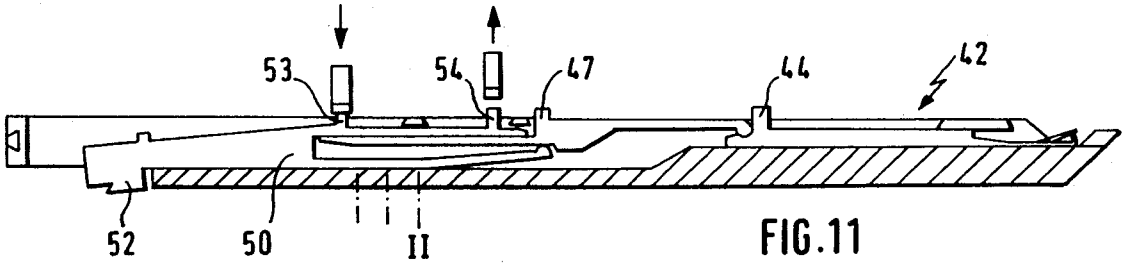
Figure 12:
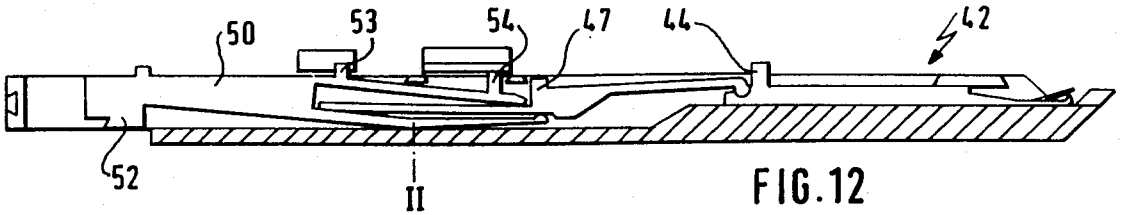

The selector jacks 50 selected by a press cam part 22 immediately adjacent the selector locality 21 are pressed by the press cam part 22, acting on its selector butt 55, out of the rest condition seen in FIG. 2 and FIG. 5 into the select position seen in FIG. 6, in which its longitudinal pusher butt 52 projects into the needle bed cut-out 25.1. This means that all the selector jacks 50 selected at the selector locality 21 when the knitting system is moved longitudinally in the direction 62 are engaged with their longitudinal pusher butt 52 by the longitudinal pusher cam part 23. The operative camming edge 23.1 of the longitudinal pusher cam part 23 is formed of inch length that all the selector jacks 50 engaged by this cam part 23 are moved into position II. This position of the selector jacks is seen in FIG. 10. After this pass of the knitting system the selector jacks 50 are thus either in position O or in position II.

Figure 4:
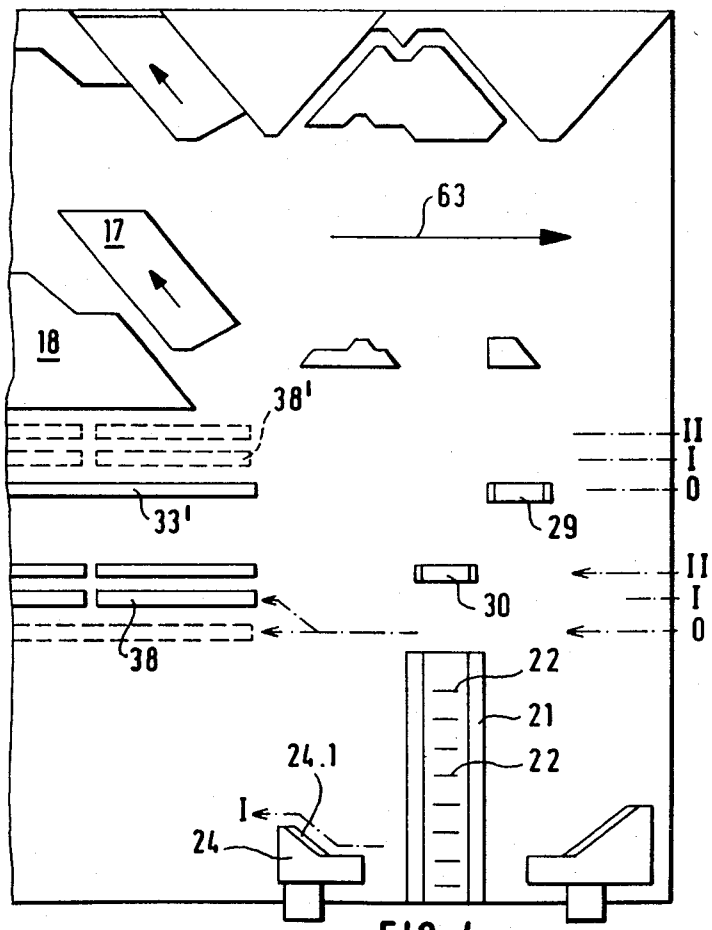
FIGS. 3 and 4 show plan views of the one half of a knitting system with the cam parts operative upon a reversal of movement of the machine in a needle selection.
Figure 7:
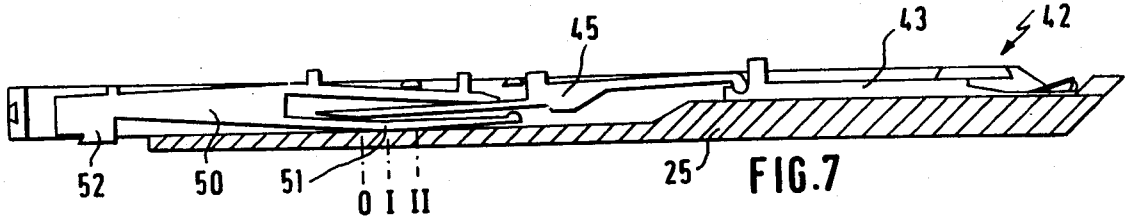

If now a relative movement of the knitting system therefore takes place in a reverse direction, that is to say in the direction of the arrow 63 shown in FIG. 4, all the selector jacks 50 disposed in position O (see FIGS. 2 and 5) are engaged at this operating butt 54 by the presenter cam part 29 and pressed into their select position also seen in FIGS. 2 and 5, so that they can be acted upon by the press cam parts 22 at the next-following selectors locality 21. On the other hand, all the selector jacks 50 disposed in position II, and thus previously selected, are engaged at their operating butt 54 by the press-down cam part 30 and thereby brought with their selector butt 55 out of the region of influence of the press cam parts 22 of the selector locality 21. Thus, upon relative movement in the direction of the arrow 63, only selector jacks 50 which are disposed in position O are acted on at the selector locality 21. The jacks hereby selected and pressed into the position seen in FIG. 6 are engaged by the next-following longitudinal pusher cam part 24. The operative camming edge 24.1 of the latter is formed only of such lengths that the selector jacks 50 engaged thereby at this longitudinal pusher butts 52 can be pushed only into position I. This position, in which the fulcrum 51 is disposed in position I, is shown in FIG. 7. After the selector jacks 50 have been moved past one selector locality 21 in two opposed directions 62 and 63, as for example can be carried out by reversing the slide in a conventional flat knitting machine, the selector jacks 50 are distributed in their three possible positions O, I, II corresponding to a predetermined pattern programme and in this distribution are arranged in the region of influence of the central press cam part and those distributed at the three positions (33–39 and 33'–39'), each with a counter-member.

Figure 8:
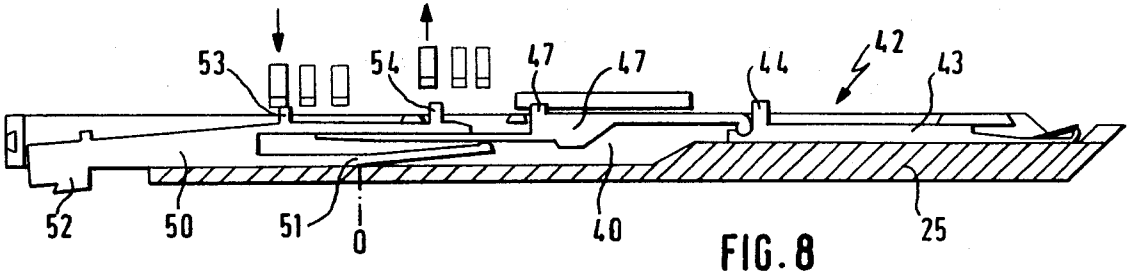
Figure 9:
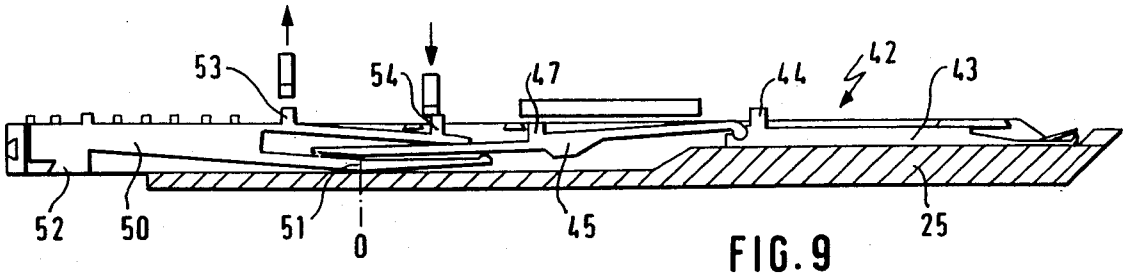

The mode of operation of the press cam parts 33, 33'–39, 39' will be hereinafter explained with reference to FIGS. 8 and 9. All these press cam parts can be moved electro-mechanically in accordance with a pattern. The press cam parts are arranged distributed at the different positions O, I, II of the selector jacks and thus at the different positions of the two operating butts 53 and 54 of the selector jacks 50. FIGS. 8 and 9 each show a selector jack 50 in position O. In FIG. 8 the selector jack is engaged at its operating butt 53 by the press cam part 33 (FIG. 1), while the other operating butt remains untouched, because the counter-member, the press cam part 33', remains switched out when the press cam part 33 is switched in. In FIGS. 3 and 4 the press cam parts, each switched out, are shown in dashed line. The operating butt 54 is thus not engaged. The press cam part 33 thus presses the selector jack 50 disposed in position O downwardly at its operating butt 53 into the low position seen in FIG. 8, the selector jack 50 being pivoted anticlockwise about its fulcrum 51. The movable needle shank 45 is thereby pivoted upwardly and thus the movable needle butt 47 is raised out of the slot 40 of the needle bed 25 and forcibly bought into the region of the cam parts 18 and 16 (FIG. 1).

FIG. 9 shows a selector jack 50 in position O, said jack being engaged at its operating butt 54 by the press cam part 33'. In this case the press cam part 33 is switched out and does not act on the other butt 53. The press cam part 33' passes the operating butt 54 downwardly and pivots the selector jack 50 clockwise about its fulcrum 51, whereby the needle shank 45 is pivoted with its needle butt 47 completely into the slot 40 of the needle bed 25. In this case the movable needle butt 47 is withdrawn from the region of influence of the opening cam part 18 and the following draw-off cam part 16. With the aid of the press cam parts 33–39 and 33'–39', in each position O, I, II of the selector jacks 50 the movable needle butt 47 can thus be brought into and out of the region of the knitting cam parts 16–18 forcibly and at determined knitting system localities established by the position of the press cam parts. FIG. 1 shows the distribution of individual press cam parts at the three possible positions of the selector jacks 50. The press cam parts 33 and 33' thus act in position O, the press cam parts 34, 36, 38, and 34', 36', 38' in position I and the press cam parts 35, 37, 39 and 35', 37', 39' in position II.

By the adjustability of the selector jacks 50 in three different positions and the movability of the movable needle butt 47 by the press cam parts in all three positions and at different localities of the drive path of the needle, new types of knitting patterns can be achieved, namely stitches and tucks which can in the same course of stitches have different lengths. The different possibilities will be hereinafter explained with reference to FIGS. 13–20.

Figure 13:
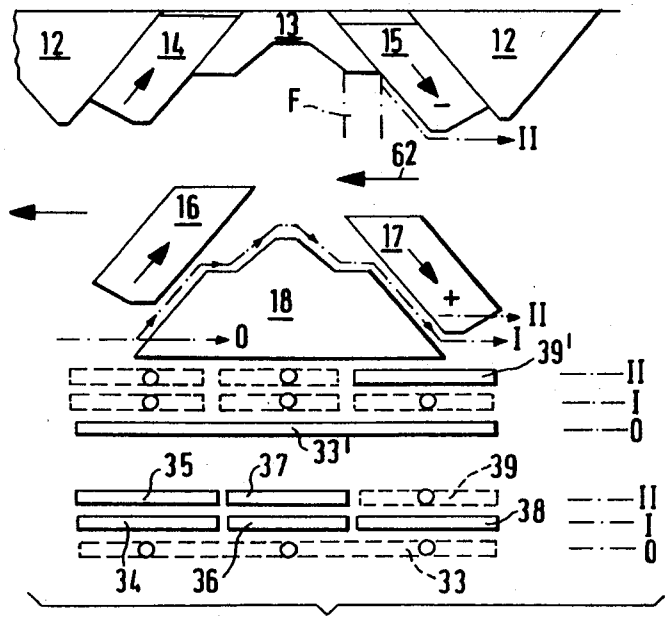
FIG. 13 shows a partial plan view of a knitting system with the cam parts arranged for achieving stitches of different lengths in one course.
Figure 14:
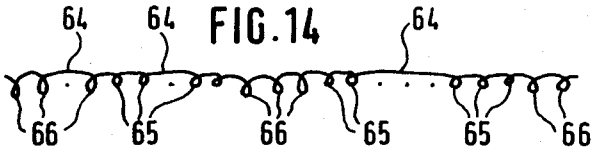
FIG. 14 shows a schematic representation of a course of knitting achieved with one cam box setting in accordance with FIG. 13.

FIG. 13 shows a setting of the press cam parts 33, 33'–39, 39', whereby stitch courses seen in FIG. 14 can be achieved, in which float stitches 64 affected by non-knitting needles, short stitches 65 and long stitches 66 are contained. In FIG. 13 the press cam parts switched in are again shown in full line and the press cam parts switched out in dashed line. The selector jacks 50 running in position O at the selector locality 21, in accordance with the double selection explained with reference to FIGS. 3 and 4, are acted on at their forward operating butt 54 by the press cam part 33'; the selector jacks disposed in position I are successively acted on at their second operating butt 53 by the press cam parts 34, 36, 38 while the selector jacks 50 disposed in position II are acted on first at their operating butt 53 by the press cam parts 35 and 37 and then at their operating butt 54 by the press cam part 39', when the knitting locality is moved relative to the needle bed 25 (not shown) in the direction of the arrow 62 drawn in.

The press cam part 34 operates in such a way that the selector jacks 50 disposed in position I bring the movable needle butt 47 into operative position by upwards pivoting of the associated needle shank 45. The needle butt 47 is thus engaged by the opening cam part 18 and then driven up into the catching position. Since the next-following press cam part 36 is also switched in, the needle shank remains with the movable needle butt 47 is thus engaged by the opening cam part 18 and then driven up into the catching position. Since the next-following press cam part 36 is also switched in, the needle shank remains with the movable needle butt 47 in operative position and the needle 42 is advanced further into the knitting position. Since the next press cam part 38 is also directed on to the operating butt 53 of the selector jack 50 and holds the needle butt 47 switched in, the needle butt 47 engages the draw-off cam part 17, the draw-off edge 17.1 of which is of greater length than the draw-off cam part 15 which is directed on to the fixed needle butt 45, so that long stitches 66 are knitted by the needles 42 which are associated with the selector jacks 50 disposed in position I.

The selector jacks disposed in position II are first engaged at their operative butt 53 by the press cam part 35 and then by the press cam part 37, and are then pressed into the position shown in FIG. 11, in which again the movable operating butt 47 of the associated needle 42 is moved into operative position and moves the needle into the knitting position. The press cam part 39, moved after the press cam part 37, is, however, de-actuated. Its counter-member, the press cam part 39', thereby actuated, and now engages the forward operating butt 54 of the selector jack 50, which is thus transferred into the position shown in FIG. 12, with the needle in its knitting position. The movable needle butt 47 is thus de-actuated, which means that for these needles the longer draw-off cam part 17 becomes ineffective and the draw-off is effected by the shorter draw-off cam part 15 acting on the fixed needle butt 44. Consequently the needles 42, the associated selector jack 50 of which is in position II, knit only short stitches 65.

The selector jacks remaining in position O are engaged at their forward operating butt 54 by the press cam part 33' and thus are bought into the position seen in FIG. 9, on which the movable needle butt 47 remains de-actuated over the whole knitting cam box region of the knitting system. The associated needles thus remain in the 'pass' position and thereby give rise to the float stitches 64 in the stitch course shown in FIG. 14.

In the exemplary embodiment illustrated the press cam parts 33 and 33' extend over the common length of the adjacent press cam parts 34, 36, 38 and 34', 36', 38'. of course the press cam parts 33 and 33' can also be separated into three separately controllable individual press cam parts. The thread insert region of the knitting cam box region of the knitting system, shown in FIG. 13, is designated F.

Figure 15:
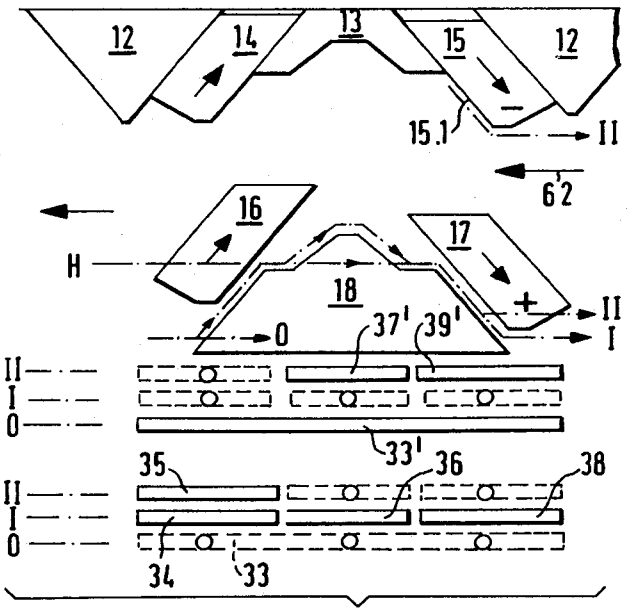
FIG. 15 shows a partial plan view of a knitting locality with the cam parts for achieving long stitches and short tucks in one course of knitting.
Figure 16:
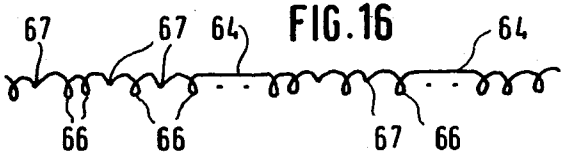
FIG. 16 shows a schematic representation of the course of knitting achievable with the cam box arrangement shown in FIG. 15.

FIG. 15 shows a combination of press cam parts by which the stitch course shown in FIG. 16 can be formed, in which course short tucks 67 are also contained as well as float stitches 64 and long stitches 66. The float stitches 64 are here caused by those needles the selector jacks 50 of which are disposed in position O and are engaged at their operating butt 54 by the press cam part 33' (see FIG. 9). The long stitches 66 are knitted by the needles 42 the associated selector jack 50 of which is disposed in position I and is there acted on successively at its operating butt 53 by the press cam parts 34, 36 and 38. The tucks 67 are formed by the needles 42 the selector jacks 50 of which are disposed in position II. These selector jacks are first engaged at this operating butt 53 by the press cam art 35 so that the movable needle butt 47 is brought into its operative position, is engaged by the opening cam part 18 and advanced into catching height H. Then, however, the selector jacks 50 disposed in position II are engaged at their forward operating butt 54 by the cam parts 37' and 39', and thus the movable needle butt 47 of the associated needles 42 is switched out. This means that these needles are advanced no further into the knitting position and also are then not engaged by the longer draw-off cam part 17, but rather with their stationary needle butt 44 run on to the draw-off cam part 15 and are drawn off on its relatively short draw-off edge 15.1 and thus draw the short tucks.

Figure 17:
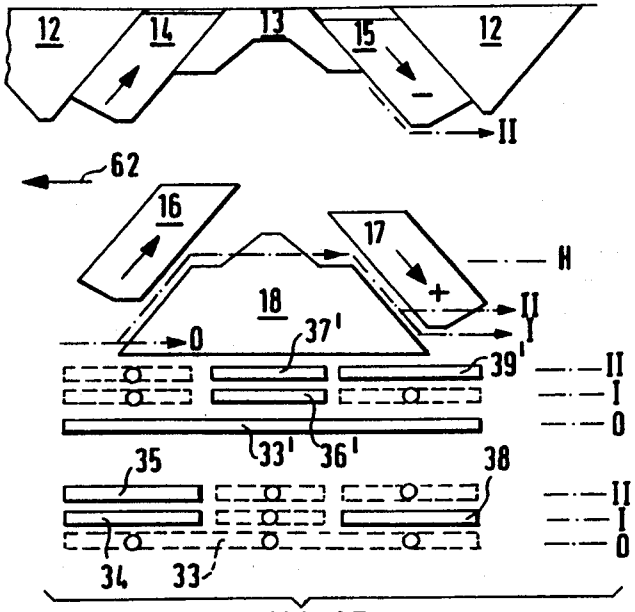
FIG. 17 shows a partial plan view of the knitting cam box, with the actuated cam parts for achieving a course of knitting having tucks of different length.
Figure 18:
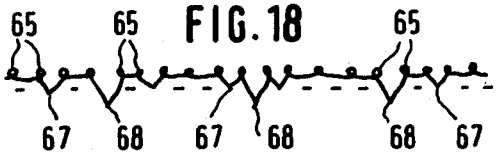
FIG. 18 shows a schematic representation of the course of knitting achievable with the cam box setting shown in FIG. 17.

FIG. 17 shows a setting of the press cam parts 33–39 and 33'–39' by which the stitch course seen in FIG. 18 can be achieved, wherein, in addition to short stitches 65, short tucks 67 and long tucks 68 are formed. The longer tucks 68 are thus formed by the needles 42 on the selector jacks 50 of which are disposed in position I, in which the press cam parts 34 and 38 effect a switching in of the movable needle butt 47 first of the catching height H and then again before the long draw-off cam part 17 is reached. The short tucks 67 are drawn by the needles 42 the associated selector jacks 50 of which are disposed in position II and is there operated by the press cam part 39' such that the draw-off movement of the needle is effected at the fixed needle butt 44 by the shorter draw-off cam part 15. The short stitches 65 are formed by the needles of the other needle bed (not shown), which are acted on by another knitting system (not shown) of an appropriately similar construction. The needles 42 of the needle bed associated with the knitting system shown in FIG. 17, the jacks 50 of which are disposed in position O, are held in the 'pass' position by the action of the press cam part 33' on the operating butt 54.

Figure 19:
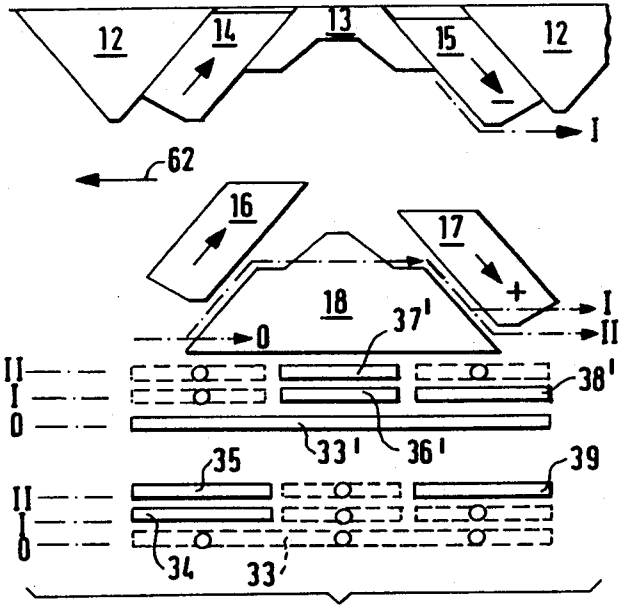
FIG. 19 shows a partial plan view of the knitting system with its cam parts in another setting.
Figure 20:
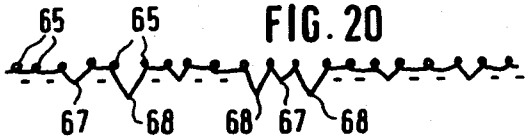
FIG. 20 shows a schematic representation of the course of knitting achievable with the cam box setting shown in FIG. 19.

FIG. 19 shows a setting of the press cam parts 33–39 and 33'–39' whereby the stitch course seen in FIG. 20 can be achieved, in which similarly short tucks 67 and long tucks 68 arise, together with short stitches 65 knitted by the needles of another needle bed. With the press cam part setting of FIG. 19, however, the long tucks 68 are formed by those needles 42 the selector jacks 50 of which are disposed in position II and are there exposed by the press cam part 39 to the long weaving cam part 17. The short tucks 67 are formed by the needles 42 the selector jacks 50 of which are disposed in position I. The selector jacks 50 disposed in position O are so acted on by the press cam part 33' that the associated needles remain in the 'pass' position.

It is further possible that the selector jacks 50 brought into position II by the longitudinal pusher cam part 23 (FIG. 1) steer the movable needle butt 47 into the region of the closing cam part 20 are the machine movement has been reversed by means of the switched-in press cam part 31 (FIGS. 1 and 4). This closing cam part 20 advances the needle 42 so far until the fixed needle butt 44 arrives at the region of influence of the transfer cam parts 10–12 (FIG. 1). In the same direction of movement the selector jacks 50 disposed in position O and in position I can now also be acted on by the press cam parts 33–39 and 33'–39' lying in the knitting cam box region of the knitting system. The result is that in the one direction of movement the needles co-operate with the selector jacks 50 disposed in position II, then immediately thereafter needles with the selector jacks 50 in position O form stitches and needles 42 with the selector jacks 50 in position I form tucks or stitches, the length of these stitches or tucks being able to be selectively determined by the draw-off cam part 17 or 15.

Figure 21:
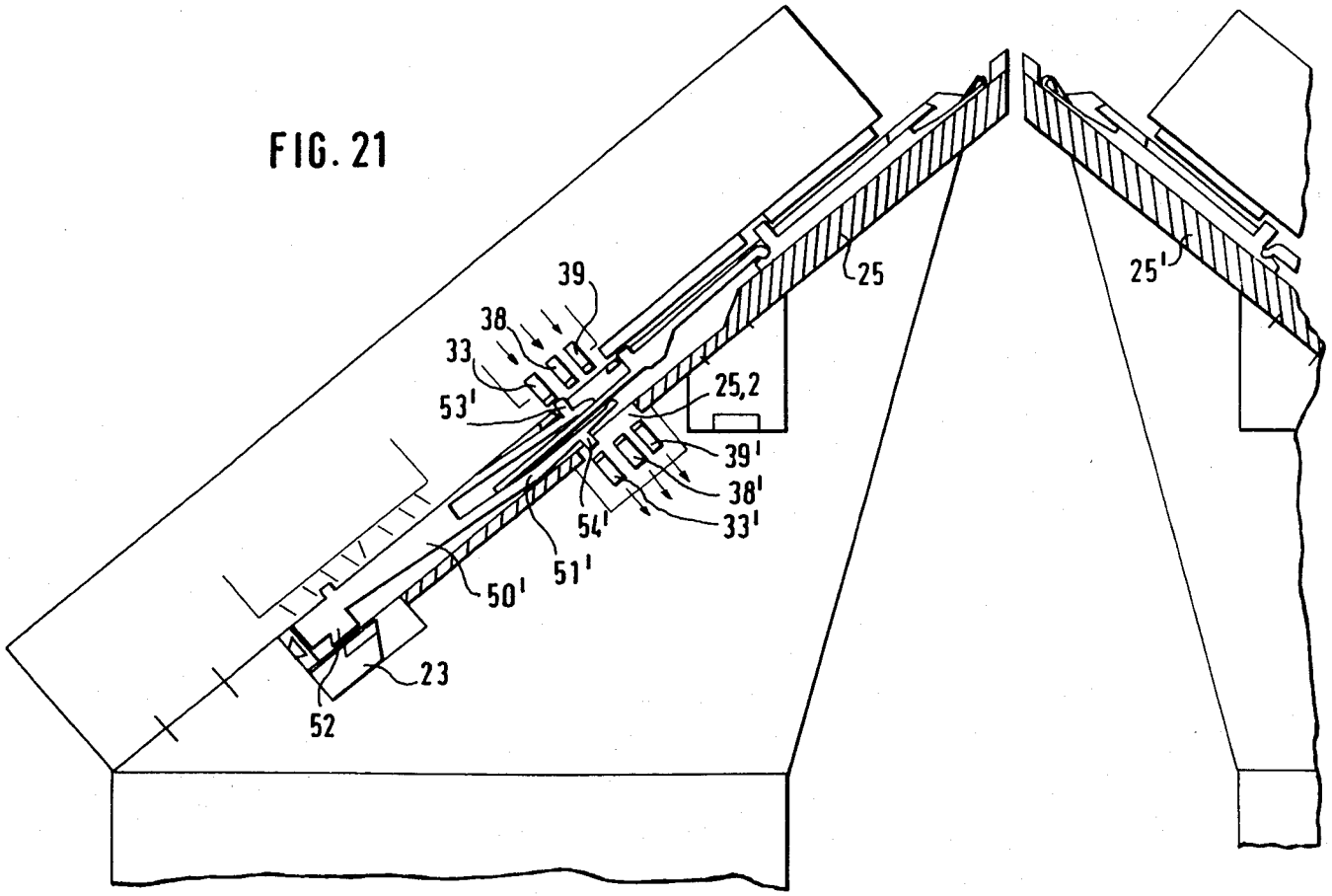
FIG. 21 shows a schematic cross-section through a V-bed flat knitting machine in which the knitting systems are fixed and the needle beds moved.

In flat knitting machines in which the needle beds 25 and 25' are arranged for movement relative to stationary knitting systems, the selector jacks 50 can, in accordance with FIG. 21, be so formed that the first operating butt 53' is formed on the upper side and the other operating butt 54' on the under-side of the selector jack, both in front of the fulcrum 51' of the selector jack 50'. The press cam parts for positions O, I and II, acting on the operating butt 54', for example the press cam part 33', 38' and 39' are then correspondingly arranged beneath the needle bed 25, 25'. The needle bed 25 is provided at this locality with a cut-out 25.2.

I claim:

1. Flat knitting machine comprising needle selector device, at least one needle bed accommodating longitudinally movable needles movable in slots, and at least one knitting system comprising cam parts, wherein needle bed and knitting system are movable relative to one another, each needle has associated therewith a selector jack which can be acted on by press cam parts and can be adjusted in the longitudinal direction of the needles between different positions, and each needle has a butt which can be moved out of the region of influence of cam parts which move the needle longitudinally, characterised in that in the direction of movement (62, 63) of the machine at each side of each needle selector locality (21) of the needle selector device is arranged a cam part (23, 24) for moving selected selector jacks (50) longitudinally, and both cam parts (23, 24) effect the longitudinal movement into different positions (I, II), in that each knitting system has, for the two directions of movement (62, 63), each a pair of adjustable draw-off cam parts (15, 17) of different draw-off length, the one (15) of which acts on a fixed butt (44) of the needles (42) and the other (17) on a butt (47) thereof which is movable by means of the selector jacks (50), and in that for each position (O, I, II) of the selector jacks (50), separately controllable press cam parts (33–39, 33'–39') are provided.

2. Flat knitting machine according to claim 1 characterised in that the movable butt (47) of the needle (42) is formed on a needle arm (45) which is pivotally connected (pivot joint 46) with the needle shank (43), which has the fixed butt (44) and is rectilinearly guided, the free end (48) of said arm (45) opening into a bifurcated opening (49) of the associated selector jack (50), which is in the form of a see-saw.

3. Flat knitting machine according to claim 2 characterized in that the selector jack (50) has at its forward end the bifurcated opening (49) for the pivotal needle arm (45), on its under-side a fulcrum (51) lying at the base of the needle slot and forming the fulcrum point, and in its rearward end region a first butt (52) which projects into a cut-out (25.1) of the needle bed (25) and co-operates with the longitudinal pusher cam part (23, 24) disposed beneath the needle bed (25), and on its upper side, in front of the fulcrum point, the first operating butt (52) and, behind the fulcrum point, a second operating butt (54), and at least one selector butt (55) which can be engaged by a selector element (22) of the needle selector device (21), and in that the knitting system has separate press cam parts (33–39; 33'–39') for each position (O, I, II) of the selector jack (50).

4. Flat knitting machine according to claim 1 characterised in that the selector jacks (50) are, after that selection at a selection locality (21), movable from a rest position (O) into two different operative positions (I, II) by means of the longitudinal pusher cam parts (23, 24) disposed at both sides of the needle selector locality (21).

5. Flat knitting machine according to claim 1 characterised in that for each position of the selector jacks (50) press cam parts (33, 33' . . . 39, 39') are arranged in pairs and under opposite control, the one press cam part (e.g. 33) of a pair acting on the first operating butt (53) of the tiltably mounted selector jacks (50) and the other press cam part (e.g. 33') of a pair of press cam parts (33, 33') acting on the second operating butt (54) thereof.

6. Flat knitting machine according to claim 1 characterised in that for each position (O, I, II) of the selector jacks (50) several press cam parts (e.g. 34, 36, 38) are arranged one behind the other in the direction of movement (62, 63) of the machine and organised for individual movement at prominent points of the path of the needle as it passes through the knitting locality.

7. Flat knitting machine according to claim 1, comprising stationary knitting localities and needle beds movable to and fro, characterised in that the two operating butts (53', 54') of the selector jacks (50') are arranged on the same side in relation to the fulcrum point (51') of the selector jacks and the one operating butt (53') is formed on the upper side and the other operating butt (54') on the under-side of the selector jacks (50') and each lower operating butt (54') lies in the region of a cut-out (25.2) in the needle bed (25) and cooperates with press cam parts (33' . . . 39') of the knitting localities arranged beneath the needle bed (25). (FIG. 21).

8. Flat knitting machine as in claim 1, with one selector jack (50) for each needle (42), which is provided with a pivotable needle arm (45), the selector jack (50) presenting a bifurcated opening (49) for pivotable needle arm (45) and this bifurcated opening being at its front end characterized in that a fulcrum (51) and, toward the back end, the pusher butt (52), are configured for the device at the bottom of needle bed slot (40), the pusher butt (52), selector jack (50) being selected, protrudes through a cutout (25.1) in needle bed (25) into the effective range of cam parts (23, 24), arranged on both sides of selector point (21) of selector devices (21/22) movable relative to needle bed (25), which cam parts act on the bottomside of needle bed (25), and that each selector jack (50) presents two operating butts (53, 54) on its top, of which the one (54) is located in front of and the other (53) to the rear of the fulcrum point of selector jack (50) formed by fulcrum (51), and that the cam system presents separate press cam parts (33–39, 33'–39') for each of the two operating buts (53, 54) in each position (O, I, II) of selector jack (50).

9. Flat knitting machine with at least one needle bed (25) with needles (42) which can be moved longitudinally in slots (40) of needle bed (25) and with at least one set of cams (10–20, 23–39) movable relative to needle bed (25), with cam parts (10–20) for the longitudinal movement of needles (42) and with a needle selector device (21/22) which is likewise movable relative to needle bed (25); each needle (42) has one fixed butt (44) and one butt (47) which can be moved transversally to the direction of needle movement out of the range of influence of the longitudinally movable cam parts (16–20) of the cam system, a selector jack (50) being associated with each needle (42), which selector jack is mounted movably in needle bed slot (40) the same as the longitudinally movable needles (42), and also is pivotable, and a selector butt (55), on which can press a selector part (22) at the selector point (21) of the needle selector device (21/22), at least one operating butt (23, 54), which can be effected by controllable press cam parts (33–35, 33'–35') of the cam system, and presents a pusher butt (52) on which, selector jack (50) being selected, one cam part (23, 24) acts on each side of selector point (21) of the needle selector device for longitudinal pushing of selector jack (5), which bring about a longitudinal movement into different positions (I, II); and the cam system for either direction of movement presenting a pair of adjustable draw-off cam parts (15, 17), which cause the different draw-off strokes of needles (42) and of which the one (15) acts on fixed butt (44) while the other (17) acts on adjustable butt (47) of needles (42), and a separately controllable press cam part (33–39, 33'–39') being provided for each position (Q, I, II) of selector jacks (50).

* * * * *